US011364511B2

(12) United States Patent
Lin et al.

(10) Patent No.: US 11,364,511 B2
(45) Date of Patent: Jun. 21, 2022

(54) SPRAY GUN SHOWER HEAD WITH AUTOMATIC RESET FUNCTION

(71) Applicant: JOMOO KITCHEN & BATH CO., LTD., Fujian (CN)

(72) Inventors: Xiaofa Lin, Fujian (CN); Xiaoshan Lin, Fujian (CN); Yinan Zheng, Fujian (CN)

(73) Assignee: JOMOO KITCHEN & BATH CO., LTD., Fujian (CN)

( * ) Notice: Subject to any disclaimer, the term of this patent is extended or adjusted under 35 U.S.C. 154(b) by 122 days.

(21) Appl. No.: 17/035,774

(22) Filed: Sep. 29, 2020

(65) Prior Publication Data

US 2021/0138488 A1 May 13, 2021

(30) Foreign Application Priority Data

Nov. 12, 2019 (CN) ..... 201911101977.1

(51) Int. Cl.
*B05B 1/16* (2006.01)
*B05B 1/18* (2006.01)

(52) U.S. Cl.
CPC ..... *B05B 1/1636* (2013.01); *B05B 1/18* (2013.01)

(58) Field of Classification Search
CPC ..... B05B 1/16; B05B 1/1627; B05B 1/1636; B05B 1/18; B05B 1/185; B05B 15/16
See application file for complete search history.

(56) References Cited

U.S. PATENT DOCUMENTS

2020/0206753 A1* 7/2020 Wu ..... B05B 1/02

FOREIGN PATENT DOCUMENTS

CN 108525876 A * 9/2018 ..... B05B 1/16
WO WO-2014166428 A1 * 10/2014 ..... B05B 1/1654
WO WO-2017047892 A1 * 3/2017 ..... A47K 3/28

* cited by examiner

*Primary Examiner* — Darren W Gorman
(74) *Attorney, Agent, or Firm* — JCIPRNET

(57) ABSTRACT

A spray gun shower head includes a shower body, a switching body and a reset assembly. The shower body has a water intake path and at least one first and second water outflow paths. The switching body is movable between first and second switch positions and configured to switch the water intake path to be communicated with the first or second water outflow path. The reset assembly includes at least one reset member and a push block. The second water outflow path is hidden in the shower body through a cover. The cover is pushed against by an opening structure to be opened. The reset member is disposed on the shower body, and one end thereof cooperates with the push block. The push block is disposed on the switching body and rotates toward the second switch position along with the switching body to press against the reset member.

14 Claims, 8 Drawing Sheets

SPRAY GUN SHOWER HEAD WITH AUTOMATIC RESET FUNCTION

CROSS-REFERENCE TO RELATED APPLICATION

This application claims the priority benefit of China application serial no. 201911101977.1, filed on Nov. 12, 2019. The entirety of the above-mentioned patent application is hereby incorporated by reference herein and made a part of this specification.

BACKGROUND

Technical Field

The disclosure relates to the field of sanitary ware, and in particular to a spray gun shower head with automatic reset function.

Description of Related Art

There are many types of existing shower heads, in which shower heads capable of spraying spray gun water have become more and more popular among consumers. Powerful spray gun water is used to clean the walls and floors of bathrooms or kitchens. However, the existing shower heads capable of spraying spray gun water still have the following defects. After using the spray gun water, the shower head is inserted into the shower holder. When the shower head is used again, the shower head placed on the shower holder or being hand-held sprays the spray gun water again. At this time, the spray gun water in the high-pressure state is likely to impact objects or human body in the bathroom, thereby causing damage or injury. Therefore, the existing shower heads capable of spraying spray gun water still need to be further improved to meet actual usage requirements and enhance user experience.

SUMMARY

The following is a summary of the subject matter of the disclosure, and the summary is not intended to limit the scope of the claims.

The disclosure is to solve the existing problems and provide a spray gun shower head with automatic reset function, which has a simple structure, reasonable design, and easy implementation, and plays a very good role in preventing damage or injury caused by spray gun water when the user forgets to switch the shower head from spraying spray gun water mode back to the normal function mode. In addition, the water outflow opening of the spray gun water is hidden and covered, which have very good protective and usage prompt effects.

The embodiment of the disclosure relates to a spray gun shower head with automatic reset function. The shower head includes a shower body, a switching body and a reset assembly. The shower body has a water intake path and at least one first water outflow path and at least one second water outflow path. The switching body is configured as a water dividing member that can at least rotate, is movable between a first switch position and a second switch position, and is configured to switch the water intake to be communicated with the first water outflow path or the second water outflow path. The second water outflow path is configured as a water outflow path for spraying spray gun water and is hidden in the shower body through a cover. The cover is pushed against by an opening structure to be opened. The reset assembly includes at least one reset member and a push block. The reset member is disposed on the shower body, and one end of the reset member cooperates with the push block. The push block is disposed on the switching body, and rotates toward the second switch position along with the switching body to press against the reset member. When the switching body loses the loading force, the switching body docks at the first switch position by the acting force of the reset member, and links with the opening structure to drive the cover to cover the second water outflow path.

BRIEF DESCRIPTION OF THE DRAWINGS

The drawings described here are used to provide further understanding of the disclosure and constitute a part of the disclosure. The exemplary embodiments and descriptions thereof of the disclosure are used to explain the disclosure and do not constitute any improper limitation of the disclosure.

DETAILED DESCRIPTION OF DISCLOSED EMBODIMENTS

Figure 1:
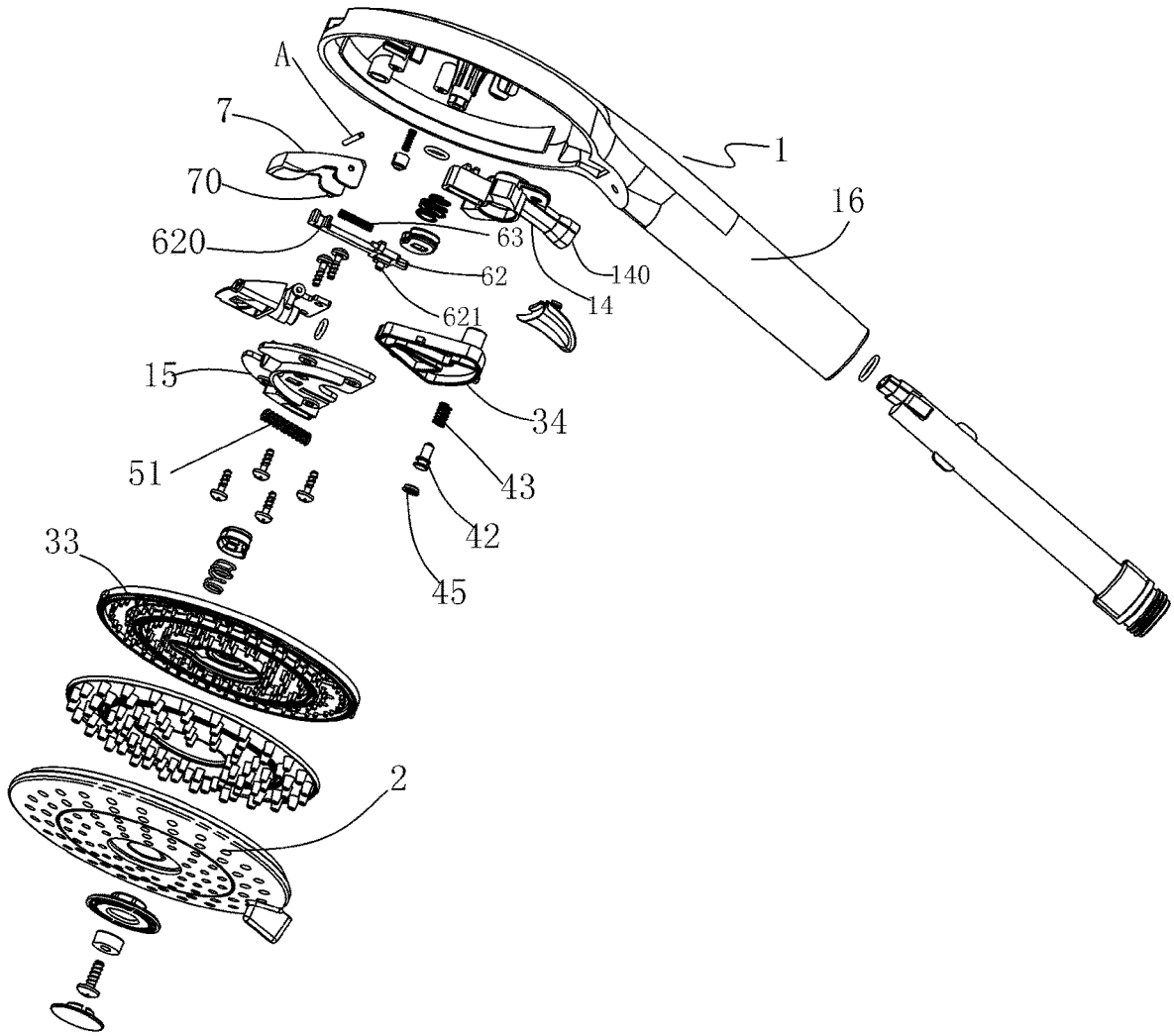
FIG. 1 is a schematic view of a three-dimensional exploded structure of a spray gun shower head according to the disclosure.
Figure 2:
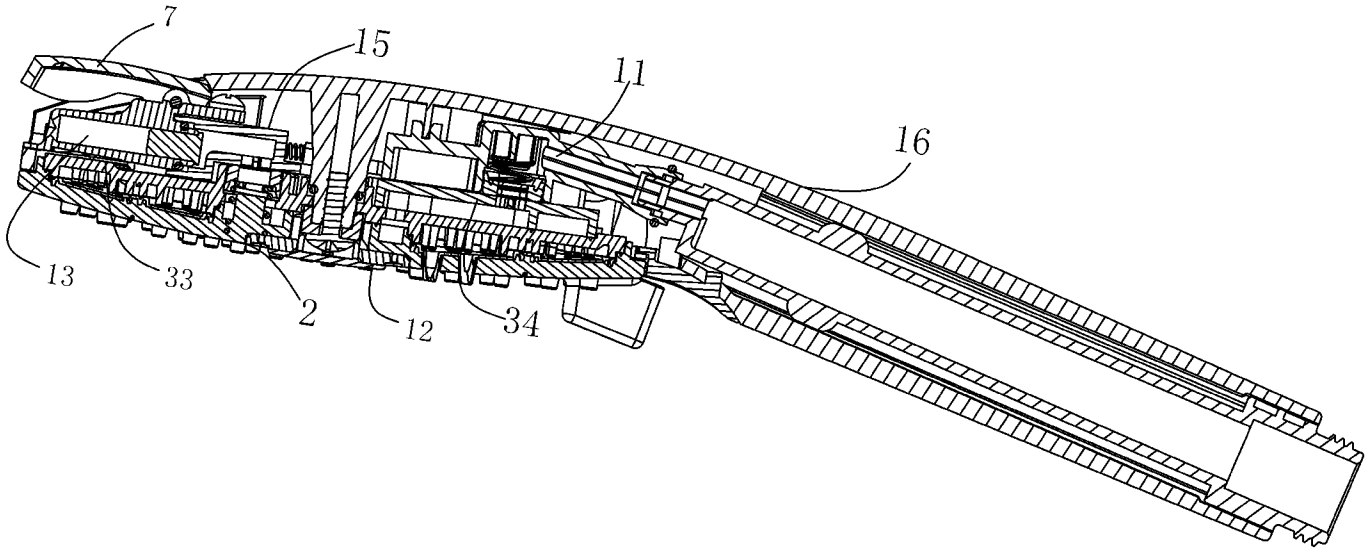
FIG. 2 is a cross-sectional view of the spray gun shower head according to the disclosure.
Figure 3:
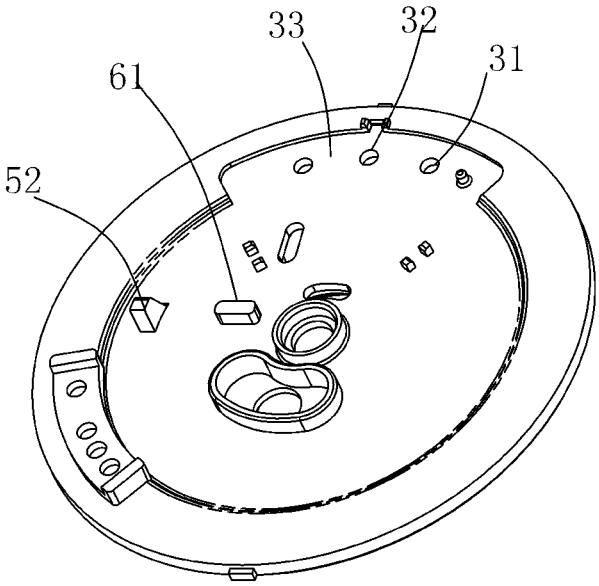
FIG. 3 is a schematic view of a three-dimensional structure of a water dividing tray according to the disclosure.
Figure 4:
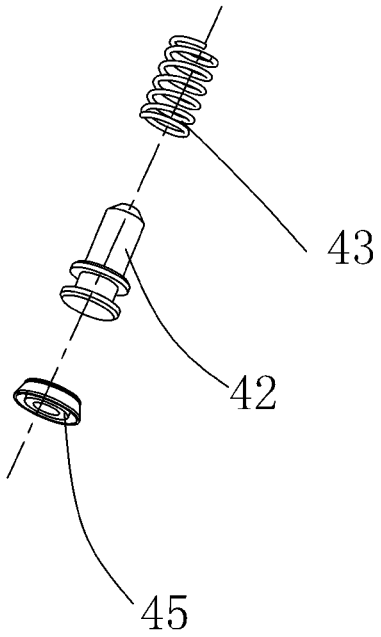
FIG. 4 is a schematic view of a three-dimensional exploded structure of a hydraulic positioning assembly according to the disclosure.
Figure 5:
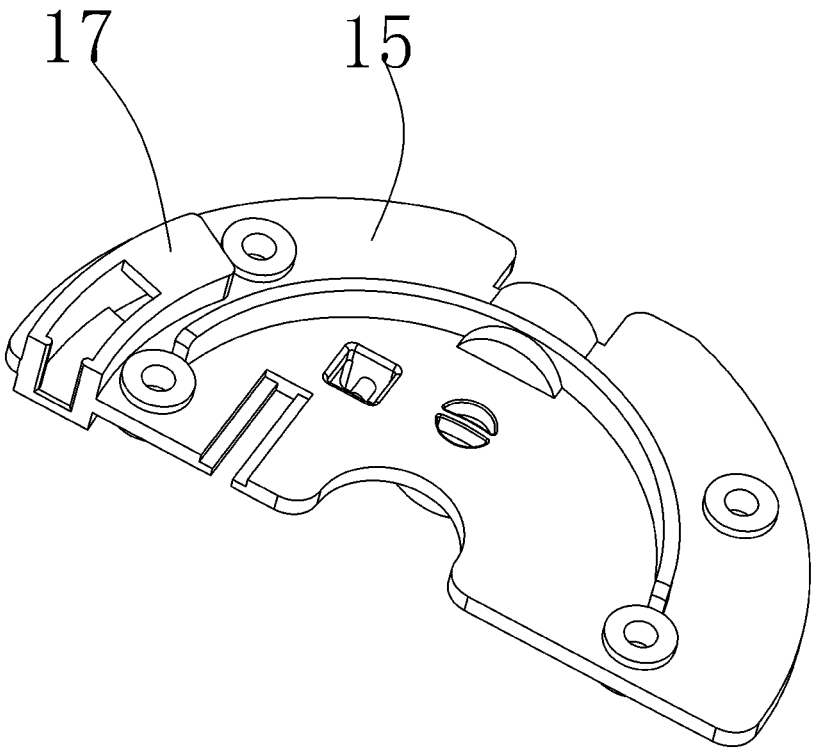
FIG. 5 is a schematic view of a three-dimensional structure of an inner stand according to the disclosure.

In order for the technical problems, technical solutions, and beneficial effects of the disclosure to be clearer and understandable, the disclosure is further described in detail below with reference to the accompanying drawings and embodiments. It should be understood that the specific embodiments described herein are only used to explain the disclosure, but not to limit the disclosure.

As shown in FIG. 1 to FIG. 5, the disclosure provides a spray gun shower head with automatic reset function. The spray gun shower head includes a shower body 1, a shower surface cover 2 and a switching body 3.

The shower body 1 is attached to the shower surface cover 2, and has a water intake path 11 and at least one first outflow path 12 and at least one second water outflow path 13. It should be noted that the shower body 1 includes a water intake body 14, an inner stand 15, and a case 16. The case 16 is a prior art and will not be discussed in detail. The water intake body 14 is configured for water intake and is disposed with a water intake opening 140 thereon. The water intake opening 140 cooperates with a water passage 30 on the switching body 3. The inner stand 15 is fixed within the case 16 and is formed with the second water outflow path 13 and a limiting member 17 thereon. It should be noted that the disclosure is exemplified by the second water outflow path 13, that is, the spray gun water path, being disposed on a top portion of the shower body 1.

The switching body 3 is configured as a water dividing member that can at least rotate, is movable between a first switch position 31 and a second switch position 32, and is configured to switch the water intake path 11 to be communicated with the first water outflow path 12 or the second water outflow path 13. The switching body 3 of the disclosure is divided into a water dividing water tray 33 and an inner receiving tray 34 that are detachably and fixedly connected to each other. The inner receiving tray 34 and the water dividing tray 33 cooperate to form several water passages. One of the water passages is the water passage 30 communicated with the second water outflow path 13. The water passage 30 is disposed with a hydraulic positioning assembly 4 therein.

This disclosure further includes the following three parts that cooperate with each other: a reset assembly 5, the hydraulic positioning assembly 4, and an opening structure 6 all are linked through the rotation of the switching body 3 to implement independent functions thereof.

The reset assembly 5 includes at least one reset member 51 and a push block 52.

The reset member 51 is disposed within the limiting member 17 formed on the inner stand 15 of the shower body 1. One end of the reset member 51 acts on an inner bottom surface of the limiting member 17, and the other end of the reset member 51 cooperates with the push block 52. It should be noted that the limiting member 17 limits the reset member 51 to the rotation track of the push block 52, so that the situation that the reset member 51 is overly deformed or misaligned during the pressuring process, which causes the switching body 3 unable to be in place when being pushed to rotate toward the first switch position 31 is prevented, and also the reset member 51 to be damaged due to disordered compression and deformation is prevented.

The push block 52 is disposed on the switching body 3, and rotates along with the switching body 3 toward the second switch position 32 to press against the reset member 51. The opening structure 6 links with the push block 52, thus pushes against a cover 7 to flip up and opens the second water outflow path 13. When the switching body 3 loses the loading force, the switching body 3 docks at the first switch position 31 by the acting force of the reset member 51, and links with the opening structure 6 to drive the cover 7 to cover the second water outflow path 13.

The hydraulic positioning assembly 4 is disposed within the second water outflow path 13. The hydraulic positioning assembly 4 is driven to move via the water flowing through the second water outflow path 13, so that the switching body 3 docks at the second switch position 32. It should be noted that in order to reduce the driving force for the positioning and docking of the switching body 3, the hydraulic positioning assembly 4 is disposed within the second water outflow path 13 and is adjacent to the edge position of the shower body 1. The hydraulic positioning assembly 4 of the disclosure is disposed away from the center position of the shower body 1.

The hydraulic positioning assembly 4 includes a positioning hole 41, a movable rod 42, a first spring 43, an accommodating groove 44, and a water stopping member 45.

The positioning hole 41 is disposed on an inner surface of the case 17 of the shower body 1 and is located on the track where the movable rod 42 rotates with the switching body 3. The accommodating groove 44 is disposed on the inner receiving tray 34. The accommodating groove 44 is communicated with the water passage 30 of the second water outflow path 13.

The movable rod 42 is disposed within the accommodating groove 44. The water stopping member 45 is disposed on one end of the movable rod 42 subjected to water pressure, and the other end of the movable rod 42 penetrates the switching body 3 and is configured to be inserted into the positioning hole 41.

The water stopping member 45 is sleeved on the movable rod 42, and cooperates with a side trough wall of the accommodating groove 44 to seal water.

Two ends of the first spring 43 respectively act on a bottom trough wall of the accommodating groove 44 and the movable rod 42.

When the switching body 3 docks at the second switch position 32, the movable rod 42 is subjected to water pressure and is inserted into the positioning hole 41 to form a positioning fit.

It should be noted that a support column 46 is disposed within the water passage 30 and corresponding to a position of the accommodating groove 44. The support column 46 supports the movable rod 42, so that the water stopping member 45 and the accommodating groove 44 are always in a cooperative water-sealing state.

The second water outflow path 13 is configured as a water outflow path for spraying spray gun water and is hidden in the shower body 1 through the cover 7. The cover 7 is pushed against by the opening structure 6 to open. It should be noted that the disclosure is exemplified by the second water outflow path 13 being disposed on a top portion of the shower body 1, and the water outflow direction of the second water outflow path 13 is at an artificially set angle with the water outflow direction of the first water outflow path 12. The cover 7 is hinged onto a back surface of the shower body 1 and blocks the second water outflow path 13. The opening structure 6 includes a linkage block 61, a transmission element 62, and a second spring 63.

In the first solution, the switching body 3 directly acts on the cover 7 without any transmission and return structure therebetween. The linkage block 61 is configured on the switching body 3. The cover 7 is disposed with a passive part 70 that cooperates with the linkage block 61. The user manually drives the switching body 3 to rotate, thereby linking the linkage block 61 to press against the passive part 70, so that the cover 7 is opened relative to the shower body 1, and the second water outflow path 13 is available. The solution has a compact and simple structure, but the pressure of water flow needs to be overcome when switching, so the operation sensation is slightly worse.

In the second solution, a transmission structure is disposed between the switching body 3 and the cover 7. Similarly, the linkage block 61 is configured on the switching body 3. The passive part 70 is disposed on the cover 7. The transmission element 62 is movably disposed on the shower body 1. The transmission element 62 forms an attachment part 620 that cooperates with the passive part 70 on the cover 7, and a pressure part 621 that pushes against the transmission element 62 through the linkage block 61. Specifically, the transmission element 62 of the embodiment is a rod body, and the rod body is slidably disposed within the shower body 1. Two ends of the second spring 63 respectively act on the shower body 1 and the transmission element 62, and are configured to drive the transmission element 62 to reset without the pressure of the linkage block 61. The transmission element 62 is displaced after being pressed against by the linkage block 61, and pushes against the passive part 70 after moving, thereby driving the end of the cover 7 away from the passive part 70 to rotatably open the second water outflow path 13 with a hinge axis A as the fulcrum. The solution requires small acting force, is easy to implement, and may be reset through the second spring 63 after switching, so the user experience is better.

The specific working principle is as follows.

Figure 6:
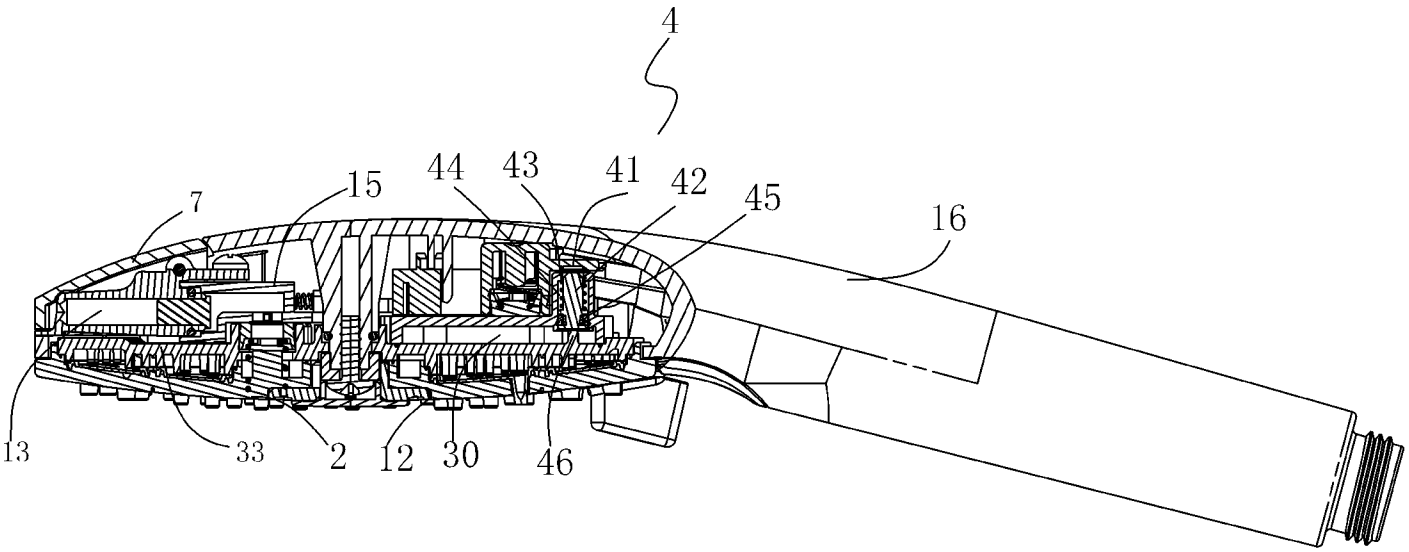
FIG. 6 is a schematic view of a three-dimensional structure of the spray gun shower head with water outflowing from a shower surface cover according to the disclosure.
Figure 7:
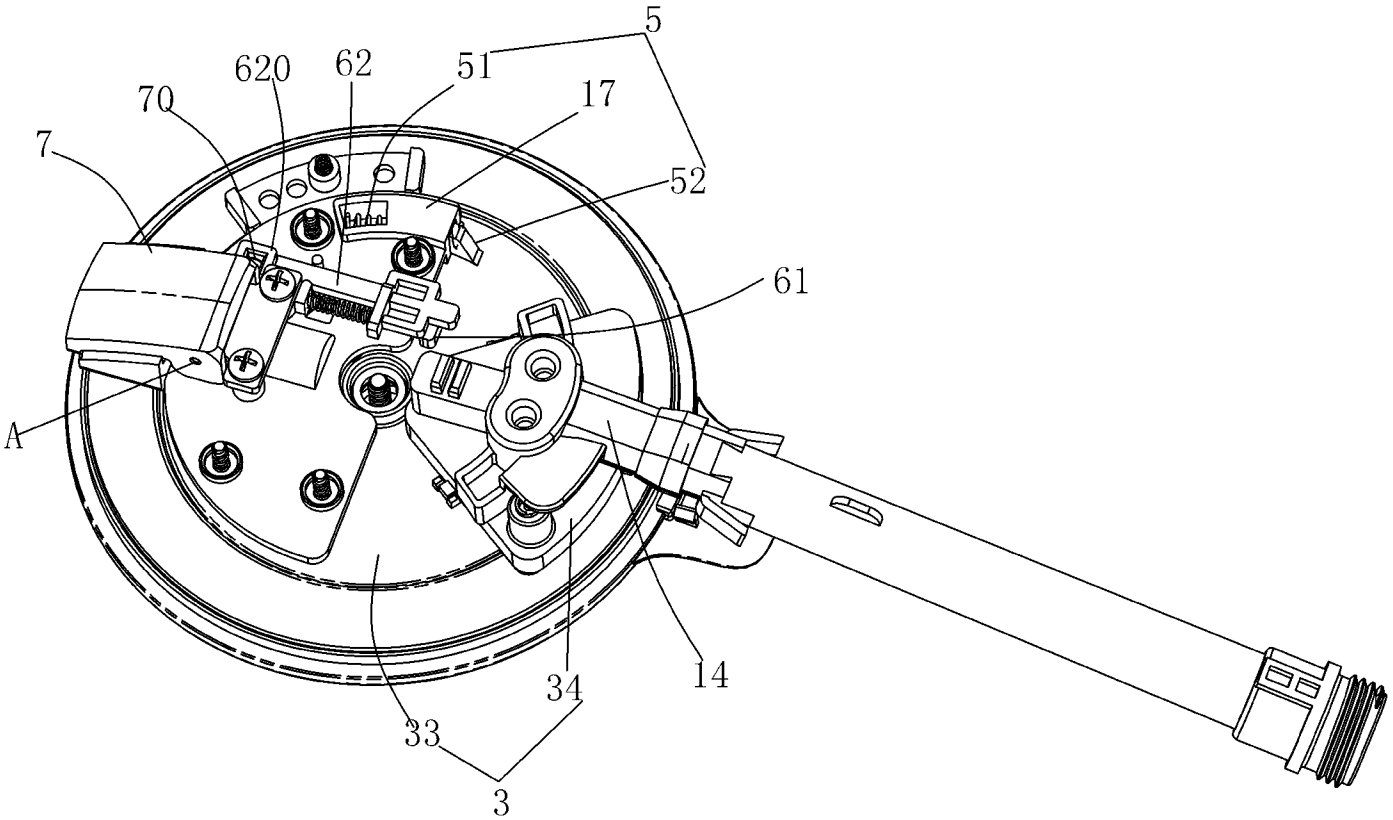
FIG. 7 is a cross-sectional view of the spray gun shower head with water outflowing from a shower surface cover according to the disclosure.

The water outflow part of the shower surface cover 2 is as shown in FIG. 6 and FIG. 7. When the switching body 3 docks at the first switch position 31, the water intake path 11 is communicated with the first water outflow path 12 (the water outflow path of the shower surface cover 2), which is the normal water outflow of the shower surface cover 2.

Figure 8:
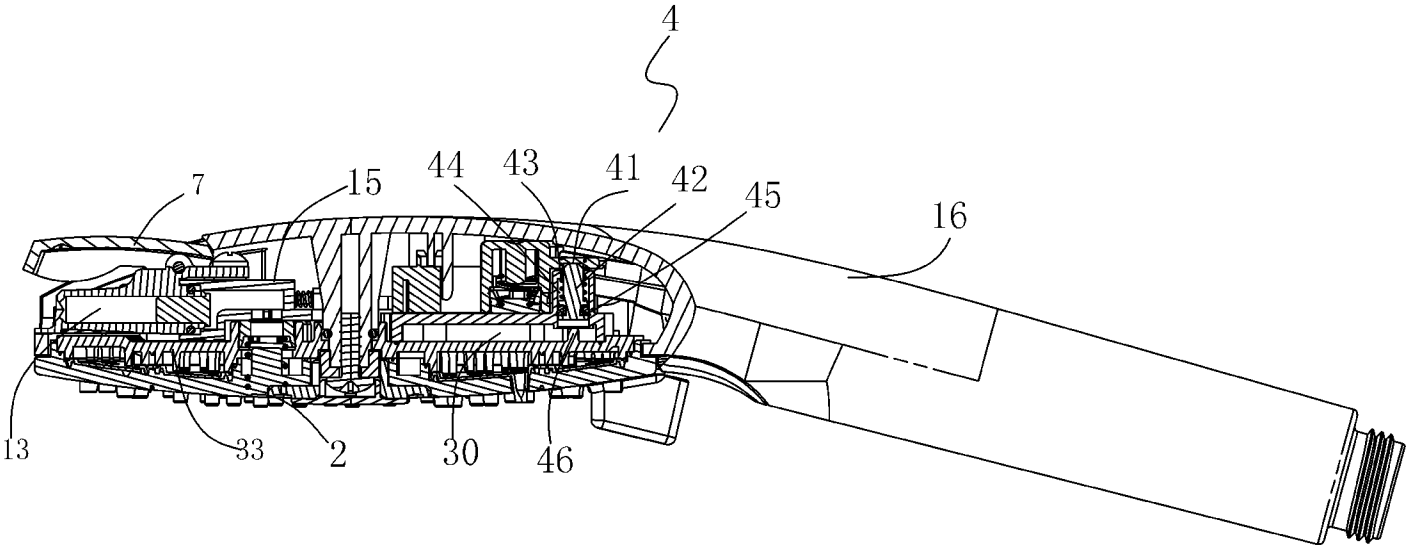
FIG. 8 is a schematic view of a three-dimensional structure of the spray gun shower head in a spray gun water outflow state according to the disclosure.
Figure 9:
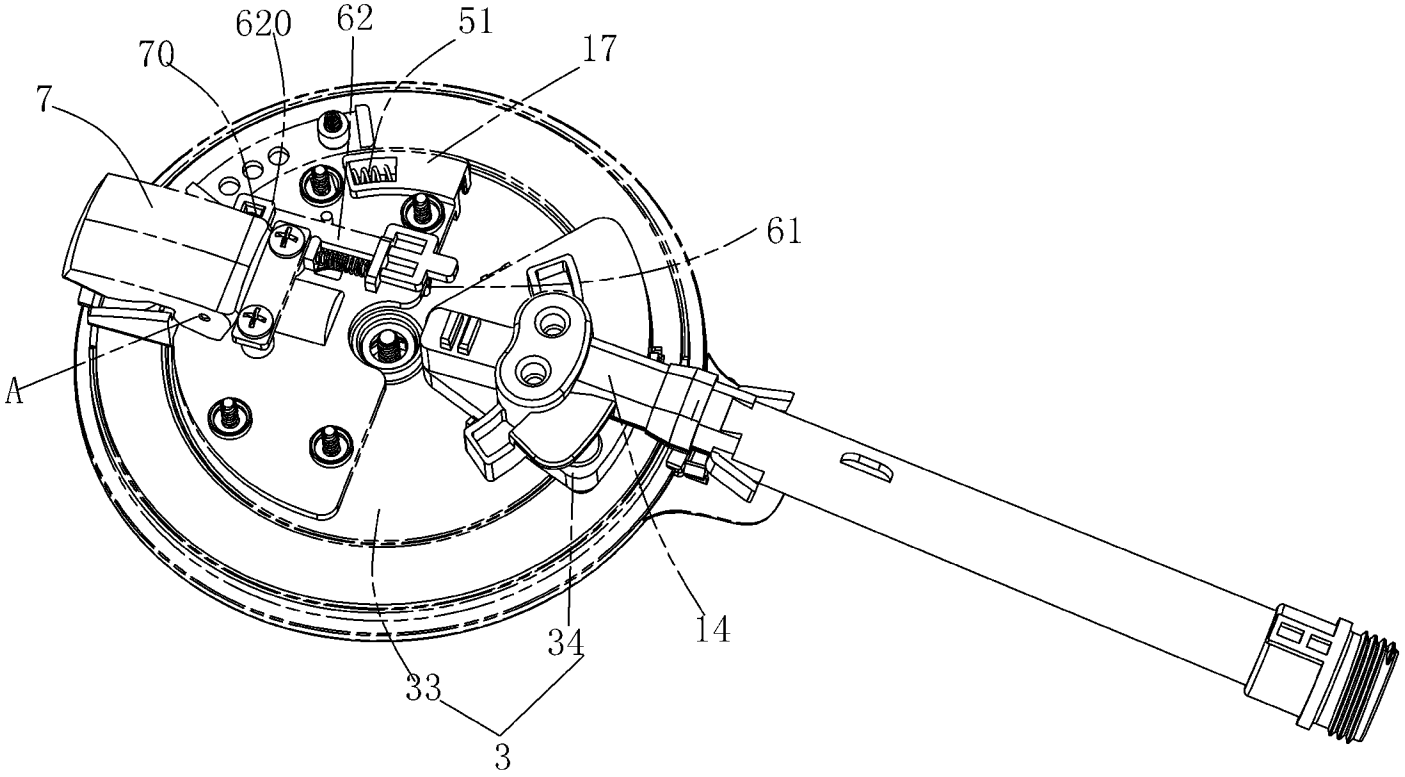
FIG. 9 is a cross-sectional view of the spray gun shower head in a spray gun water outflow state according to the disclosure.

When the spray gun water needs to be used (as shown in FIG. 8 and FIG. 9), only the switching body 3 attached to the shower surface cover 2 needs to be rotated. When the switching body 3 rotates from the first switch position 31 to the second switch position 32, the push block 52 and the linkage block 61 on the switching body moves synchronously with the rotation of the switching body 3. At this time, the push block 52 enters the limiting member 17, and gradually compresses the reset member 51 (here, the reset member 51 is exemplified by a spring, which may, of course, also be other parts that may be deformed and compressed and return to the original shape after losing the loading force). The linkage block 61 also pushes the transmission element 62 connected to move. The transmission element 62 is displaced after being pressed against by the linkage block 61, and pushes against the passive part 70 after moving, thereby driving the end of the cover 7 away from the passive part 70 to rotatably open the cover 7 with the hinge axis A as the fulcrum. After the switching body 3 is rotated to the second switch position 32, the water intake path 11 is in communication with the water passage 30. When the water flows through the bottom part of the support column 46, the water pressure pushes against the water stopping member 45. The water stopping member 45 drives the movable rod 42 connected to move after being pressured, so that the movable rod 42 is moved in a direction toward the positioning hole 41 until one end of the movable rod 42 is inserted into the positioning hole 41 to form positioning. At this time, the spray gun water is kept in the spraying state through the acting force of the water flow and hydraulic positioning without hand support.

After use, the switch valve is closed, and water no longer enters the water intake path 11. The pressure of the water flowing through the water passage 30 becomes smaller. When the pressure is less than the acting force of the second spring 63, the movable rod 42 is driven back to the support column 46. At this time, the movable rod 42 exits the positioning hole 41 without the limitation of the positioning hole 41. The reset member 51 also drives the switching body 3 to move from the second switch position 32 toward the first switch position 31. During the movement process, the push block 52 and the linkage block 61 on the switching body 3 both return to the original positions. The transmission element 62 that cooperates with the linkage block 61 returns to the original position under the action of the first spring 43, and links with the cover 7 to swing with the hinge axis as the fulcrum, so as to cover up the shower body 1.

The disclosure provides a spray gun shower head driven by water pressure, which has a simple structure, reasonable design, and easy implementation. The switching function and the spraying spray gun water function of the existing shower head can be integrated in the same rotational operation structure. The reset assembly is used to drive the switching body to automatically reset to the spraying normal water state, that is, after using the spraying spray gun water function, the switching body can be driven to automatically switch to the spraying normal water mode, so as to prevent accidental spraying when the next user turns on the shower head due to the spray gun shower head being at the spraying spray gun water mode after the previous use, which has a good protective effect. The design is more in line with consumer habits, has better safety, and better user experience. In addition, the water outflow opening of the spray gun water is further covered and hidden with the cover, which not only plays a good protective role, but also has a prompt effect after opening the cover. The disclosure further provides the limiting member, so that the reset member can be kept on the movement track of the push block, which ensures the stability of the structure and has certain limitation and protective effects on the reset member, so as to prevent the situation that the reset member is unable to drive the switching body to switch to the first switch position due to external force and also prevent the situation that the shower head is damaged due to internal pressure incurred when no water outflow is from the water outflow path. This disclosure further includes the hydraulic positioning assembly, which is disposed within the second water outflow path. The hydraulic positioning assembly is driven by the water flowing through the second water outflow path, so that the switching body docks at the second switch position. By using water pressure as the driving force, the design only enables the switching body to dock when water flows through the second water outflow path. When no water is supplied, the hydraulic positioning assembly does not work due to the loss of water pressure loading. The design enables the switching body to be kept in the water outflow state when the switching body is at the second switch position without the need to manually exert a force on the switching body. More importantly, the second switch position can be stably kept even when the water pressure is changing. The structure implements the effects of freeing the hand from continuous holding, stable use under pressure change, and better user experience. The hydraulic positioning assembly of the disclosure is disposed within the second water outflow path and is adjacent to the edge position of the shower body. In this way, the positioning force that drives the hydraulic positioning assembly could be smaller. The farther from the center position of the shower body, the smaller the positioning force will be, which ensures the hydraulic positioning assembly remains at the second switch position more stably after switching and better stability. The hydraulic positioning assembly of the disclosure has a simple structure and an ingenious design. The movable rod can only be displaced by water pressure and inserted into the positioning hole when the spray gun water passes through the water passage. The water outflow state is kept and the movable rod does not return to the original position due to the action of the reset member. In the disclosure, the accommodating groove also cooperates with the water stopping member to prevent the water flow from leaking from the insertion hole of the movable rod to weaken the water potential while having very good waterproof and sealing effects. The disclosure further provides the support column to ensure that while the water stopping member is always kept in the water sealing state, water can flow through smoothly and the water stopping member can be pushed to move quickly. By the cooperation between the linkage block and the switching body, the disclosure implements the switching of the spray gun water while implementing the opening and closing of the cover. Two functions are controlled by one action, which saves manufacturing costs and has a more compact structure. The cover of the disclosure is disposed on the shower body by adopting a hinged manner. The transmission element and the second spring serve as the transmission structure. The cover swings relative to the shower body and is opened by the rotation movement, and is automatically reset when switched to other functions (such as shower function). In the disclosure, the water outflow opening of the spray gun water is disposed on top of the shower body, and is disposed at a certain angle with a water outflow opening of the shower function, so that the water outflow opening of the spray gun water and the water outflow opening of the shower function are obviously distinguished. Also, when using the spray gun water function, the hand holding posture is more suitable and convenient for the users to use. In addition, the cover is hinged to the back surface of the shower body, which not only does not affect the water outflow and appearance of the shower head part, but also has a prompt effect on the back cover for using the high-pressure spray gun water.

The above descriptions illustrate and describe the preferred embodiments of the disclosure. As mentioned above, it should be understood that the disclosure is not limited to the form disclosed herein, and should not be regarded as an exclusion of other embodiments, but may be used for various other combinations, modifications, and environments, and may be modified through the above teachings or technology or knowledge in related fields within the scope of the inventive concept described herein. The modifications and changes made by persons skilled in the art do not depart from the scope of the disclosure, and should fall within the protection scope of the appended claims of the disclosure.

What is claimed is:

1. A spray gun shower head with automatic reset function, the spray gun shower head comprising:

a shower body, having a water intake path and at least one first water outflow path and second water outflow path;

a switching body, configured as a water dividing member that at least rotates, movable between a first switch position and a second switch position, and configured to switch the water intake path to be communicated with the at least one first water outflow path or the second water outflow path, wherein the second water outflow path is configured as a water outflow path for spraying spray gun water and is hidden in the shower body through a cover, and the cover is adapted to be pushed against by an opening structure to be opened; and a reset assembly, including at least one reset member and a push block, wherein the at least one reset member is disposed on the shower body, and one end of the at least one reset member cooperates with the push block; and the push block is disposed on the switching body and rotates toward the second switch position along with the switching body to press against the at least one reset member, wherein when the switching body loses loading force, the switching body docks at the first switch position by acting force of the at least one reset member, and links with the opening structure to drive the cover to cover the second water outflow path.

2. The spray gun shower head with automatic reset function according to claim 1, further comprising a limiting member, disposed on the shower body, wherein the at least one reset member is disposed in the limiting member, and the limiting member limits the reset member to a rotation track of the push block.

3. The spray gun shower head with automatic reset function according to claim 2, further comprising a hydraulic positioning assembly, disposed within the second water outflow path, wherein the hydraulic positioning assembly is driven to move via water flowing through the second water outflow path, so that the switching body docks at the second switch position.

4. The spray gun shower head with automatic reset function according to claim 3, wherein the hydraulic positioning assembly is disposed within the second water outflow path and is adjacent to an edge position of the shower body.

5. The spray gun shower head with automatic reset function according to claim 3, wherein the hydraulic positioning assembly comprises a positioning hole, a movable rod, and a first spring, the positioning hole is disposed on the shower body, one end of the movable rod is located within a water passage of the second water outflow path, and another end of the movable rod penetrates the switching body, when the switching body docks at the second switch position, the movable rod is subjected to water pressure and is inserted into the positioning hole to form a positioning fit, the first spring is sleeved on the movable rod, and two ends of the first spring respectively act on the switching body and the movable rod.

6. The spray gun shower head with automatic reset function according to claim 5, wherein the hydraulic positioning assembly further comprises an accommodating groove and a water stopping member, the accommodating groove is disposed within the switching body and is communicated with the water passage, the movable rod is disposed within the accommodating groove, the water stopping member is disposed on one end of the movable rod subjected to water pressure, the water stopping member cooperates with a side trough wall of the accommodating groove to seal water, and the two ends of the first spring respectively act on a bottom trough wall of the accommodating groove and the movable rod.

7. The spray gun shower head with automatic reset function according to claim 6, wherein a support column is disposed within the water passage and corresponds to a position of the accommodating groove, and the support column supports the movable rod, so that the water stopping member and the accommodating groove are always in a cooperative water-sealing state.

8. The spray gun shower head with automatic reset function according to claim 4, wherein the hydraulic positioning assembly comprises a positioning hole, a movable rod, and a first spring, the positioning hole is disposed on the shower body, one end of the movable rod is located within a water passage of the second water outflow path, and another end of the movable rod penetrates the switching body, when the switching body docks at the second switch position, the movable rod is subjected to water pressure and is inserted into the positioning hole to form a positioning fit, the first spring is sleeved on the movable rod, and two ends of the first spring respectively act on the switching body and the movable rod.

9. The spray gun shower head with automatic reset function according to claim 1, wherein the opening structure comprises a linkage block configured on the switching body and a passive part disposed on the cover and cooperating with the linkage block, and the switching body is rotatable to link with the linkage block thereon to press against the passive part, so that the cover opens relative to the shower body and the second water outflow path is available.

10. The spray gun shower head with automatic reset function according to claim 9, wherein the opening structure further comprises a transmission element and a second spring, wherein the transmission element is movably disposed on the shower body and forms an attachment part that cooperates with the passive part on the cover and a pressure part that pushes against the transmission element through the linkage block, two ends of the second spring respectively act on the shower body and the transmission element, and are configured to drive the transmission element to reset without being pressed against by the linkage block, and the transmission element is displaced after being pressed against by the linkage block and drives the cover to swing with a hinge axis as a fulcrum, so as to open the second water outflow path.

11. The spray gun shower head with automatic reset function according to claim 10, wherein the second water outflow path is disposed on a top portion of the shower body, and a water outflow direction of the second water outflow path is at an artificially set angle with a water outflow direction of the at least one first outflow path; and the cover is hinged to a back surface of the shower body and blocks the second water outflow path.

12. The spray gun shower head with automatic reset function according to claim 2, wherein the opening structure comprises a linkage block configured on the switching body and a passive part disposed on the cover and cooperating with the linkage block, and the switching body is rotatable to link with the linkage block thereon to press against the passive part, so that the cover opens relative to the shower body and the second water outflow path is available.

13. The spray gun shower head with automatic reset function according to claim 3, wherein the opening structure comprises a linkage block configured on the switching body and a passive part disposed on the cover and cooperating with the linkage block, and the switching body is rotatable to link with the linkage block thereon to press against the passive part, so that the cover opens relative to the shower body and the second water outflow path is available.

14. The spray gun shower head with automatic reset function according to claim 4, wherein the opening structure comprises a linkage block configured on the switching body and a passive part disposed on the cover and cooperating with the linkage block, and the switching body is rotatable to link with the linkage block thereon to press against the passive part, so that the cover opens relative to the shower body and the second water outflow path is available.

* * * * *